US007823799B2

(12) United States Patent
Sakai et al.

(10) Patent No.: US 7,823,799 B2
(45) Date of Patent: Nov. 2, 2010

(54) HEAT-PUMP-TYPE WATER HEATER

(75) Inventors: Kunio Sakai, Fuji (JP); Akira Konagai, Fuji (JP); Masahiko Sasaki, Fuji (JP); Seiji Ookoshi, Fuji (JP)

(73) Assignee: Toshiba Carrier Corporation, Tokyo (JP)

( * ) Notice: Subject to any disclaimer, the term of this patent is extended or adjusted under 35 U.S.C. 154(b) by 0 days.

(21) Appl. No.: 11/965,171

(22) Filed: Dec. 27, 2007

(65) Prior Publication Data

US 2008/0135636 A1 Jun. 12, 2008

Related U.S. Application Data

(63) Continuation of application No. PCT/JP2006/312735, filed on Jun. 26, 2006.

(30) Foreign Application Priority Data

Jun. 30, 2005 (JP) ..... 2005-192033

(51) Int. Cl.
*F24D 3/08* (2006.01)
*F24D 11/02* (2006.01)
*F24H 1/00* (2006.01)
*F24H 1/18* (2006.01)

(52) U.S. Cl. ..... 237/19; 237/2 B; 62/238.6; 62/238.7

(58) Field of Classification Search ..... 237/2 B, 237/19; 62/238.7, 238.6
See application file for complete search history.

(56) References Cited

U.S. PATENT DOCUMENTS 2,102,171 A * 12/1937 Vandoren ..... 62/339
2,816,513 A * 12/1957 Watson ..... 418/169
3,018,642 A * 1/1962 Lathrop ..... 62/427

(Continued)

FOREIGN PATENT DOCUMENTS

EP 1767879 A1 * 3/2007

(Continued)

OTHER PUBLICATIONS

English abstract of WO 2005/106346.

(Continued)

*Primary Examiner*—Steven B McAllister
*Assistant Examiner*—Patrick F. O'Reilly, III
(74) *Attorney, Agent, or Firm*—DLA Piper LLP US

(57) ABSTRACT

A heat source unit includes a compressor, a heat-source-side heat exchanger, an outdoor blower, and a controller for electric devices. A hydrothermal exchange unit accommodates water heat exchangers, water pipes, pumps and a controller, and is connected to the heat source unit via refrigerating pipes and electric wiring. A tank unit has tanks for storing hot water obtained as a result of heat exchange by the water heat exchangers. The hydrothermal exchange unit has a housing. The front, rear, upper, left and right sides of the housing are covered with panels. A bottom plate for the housing is disposed a predetermined distance above the lower end of the housing. The housing accommodates the hydrothermal exchange unit, and a space below the bottom plate of the housing accommodates connectors for the water pipes and refrigerant pipes. This completely prevents freezing of the water pipes, makes use-side units compact, and improves operation efficiency.

8 Claims, 5 Drawing Sheets

U.S. PATENT DOCUMENTS

| | | | | |
|---|---|---|---|---|
| 4,909,041 | A * | 3/1990 | Jones | 62/99 |
| 4,993,483 | A | 2/1991 | Harris | |
| 5,269,153 | A * | 12/1993 | Cawley | 62/180 |
| 5,937,663 | A * | 8/1999 | Chen et al. | 62/238.7 |
| 5,984,198 | A * | 11/1999 | Bennett et al. | 237/2 B |
| 2004/0134227 | A1 * | 7/2004 | Kolda et al. | 62/508 |
| 2004/0159110 | A1 | 8/2004 | Janssen | |

FOREIGN PATENT DOCUMENTS

| | | |
|---|---|---|
| JP | 2-141797 | 11/1990 |
| JP | 2001-082818 | 3/2001 |
| JP | 2003-314891 | 11/2003 |
| JP | 2005-164136 | 6/2005 |
| WO | WO2005/106346 | 11/2005 |

OTHER PUBLICATIONS

English abstract of JP-2005-164136.
English Abstract of JP-2003-314891.
English abstract of JP-2001-082818.
Search Report from WO 2007/004460.
Office Action issued in Canadian Appl 2,613,820 on Mar. 5, 2010.
Office Action issued in JP Appl 2007-523938 on Aug. 31, 2010.
English Language Translation of Office Action issued in JP Appl 2007-523938 on Aug. 31, 2010.

* cited by examiner

HEAT-PUMP-TYPE WATER HEATER

CROSS REFERENCE TO RELATED APPLICATIONS

This is a Continuation Application of PCT Application No. PCT/JP2006/312735, filed Jun. 26, 2006, which was published under PCT Article 21(2) in Japanese.

This application is based upon and claims the benefit of priority from prior Japanese Patent Application No. 2005-192033, filed Jun. 30, 2005, the entire contents of which are incorporated herein by reference.

BACKGROUND OF THE INVENTION

1. Field of the Invention

The present invention relates to a heat-pump-type water heater provided with a heat-pump-type refrigeration cycle and used to supply hot water that can also be used for heating.

2. Description of the Related Art

A heat pump system is becoming widespread. The heat pump system has a water heat exchanger, which has replaced an air heat exchanger. The heat pump system is constructed separately from an outdoor machine. Jpn. Pat. Appln. KOKAI Publication No. 2001-082818, for example, discloses a heat pump system and a heat pump system installation method. As use side units, this heat pump system allows the functions of hot water supply, reheating of bathtub water by a circulation pump, air conditioning, etc., and the number of units can be decreased or increased. The configuration of the system is relatively simple and allows the use of an existing unit.

Specifically, this heat pump system includes: an outdoor unit having a compressor, outdoor heat exchanger, and electronic expansion valve; a hot water storage unit having a hot water storage tank connected to the outdoor unit by means of a refrigerant pipe, and a water heat exchanger for hot water supply; a reheating unit having a heat exchanger for reheating, which is connected to the outdoor unit via the hot water storage unit by means of the refrigerant pipe; and an air conditioning unit for heating, which is connected to the outdoor unit via the hot water storage unit by means of the refrigerant pipe.

BRIEF SUMMARY OF THE INVENTION

In the technology disclosed in Jpn. Pat. Appln. KOKAI Publication No. 2001-082818, only the air conditioner for heating, which has the heat exchanger for heating, is disposed indoors. The hot water storage unit having the heat exchanger for hot water supply and the hot water storage tank, and the reheating unit having the heat exchanger for reheating are disposed outdoors together with the outdoor unit having the compressor and outdoor heat exchanger (refer to paragraph number [0065] and FIG. 9).

The water heat exchangers incorporated in the hot water storage unit and reheating unit are connected with the tank, bathtub, etc., via the water pipes. Some of the water pipes extend outdoors and are directly affected by the outdoor air temperature.

As a matter of course, the water pipes laid outdoors are not exposed because they are wrapped in an insulating material. However, if the water heater is installed in a cold district or other district where air temperature drops extremely in winter, the insulating effects of the insulting material may be degraded and water in the pipes may freeze. Additionally, the insulating material may deteriorate because of its use over a long period. For these reasons, it is preferable that the water pipes be laid indoors.

Additionally, in the technology disclosed in Jpn. Pat. Appln. KOKAI Publication No. 2001-082818, the water storage unit and reheating unit on the use side have their respective water heat exchangers. However, the water heat exchangers may be used for the refrigeration cycle circuit as well. The units extending from the use side to the refrigeration cycle circuit are, therefore, extremely large and narrow conditions for installation.

The foregoing configuration cannot ensure the supply of hot water which matches the load on each use-side unit, resulting in adverse effects on the operating efficiency. On the basis of the information given above, it is preferable that the water heat exchanger on each use-side unit be independent.

The present invention has been made in view of the drawbacks discussed above. It is therefore an object of the invention to provide a heat-pump-type water heater that completely prevents freezing of water pipes, has compact use-side units with improved operating efficiency, and improves appearance by covering pipe connectors.

In a heat-pump-type water heater according to an aspect of the present invention having a heat source unit including: a compressor, a pressure reducing mechanism, and a heat-source-side heat exchanger, all of which compose one section of a heat-pump-type refrigeration cycle, and a controller which controls operations of an outdoor blower and electric devices, a hydrothermal exchange unit disposed apart from the heat source unit, connected to the heat source unit by means of refrigerant pipes and electric wiring, and including: a water heat exchanger composing part of the other section of the heat-pump-type refrigeration cycle and serving as a use side heat exchanger; a pump which guides water via a water pipe to the water heat exchanger; and a controller which controls the operation of the pump, and a tank unit connected to the hydrothermal exchange unit via water pipes and including a tank which stores hot water obtained as a result of heat exchange by the water heat exchanger, wherein the hydrothermal exchange unit has a housing, the front, rear, top, left and right sides of the housing being covered with panels and a bottom plate for the housing being disposed a predetermined distance above lower ends of the panels, and the housing accommodates the water heat exchanger, the pump, the water pipes, the refrigerant pipes, and the controller, and a space below the bottom plate of the housing accommodates connectors for the water pipes and refrigerant pipes.

DETAILED DESCRIPTION OF THE INVENTION

An embodiment of a heat-pump-type water heater according to the present invention will now be described with reference to the accompanying drawings.

Figure 1:
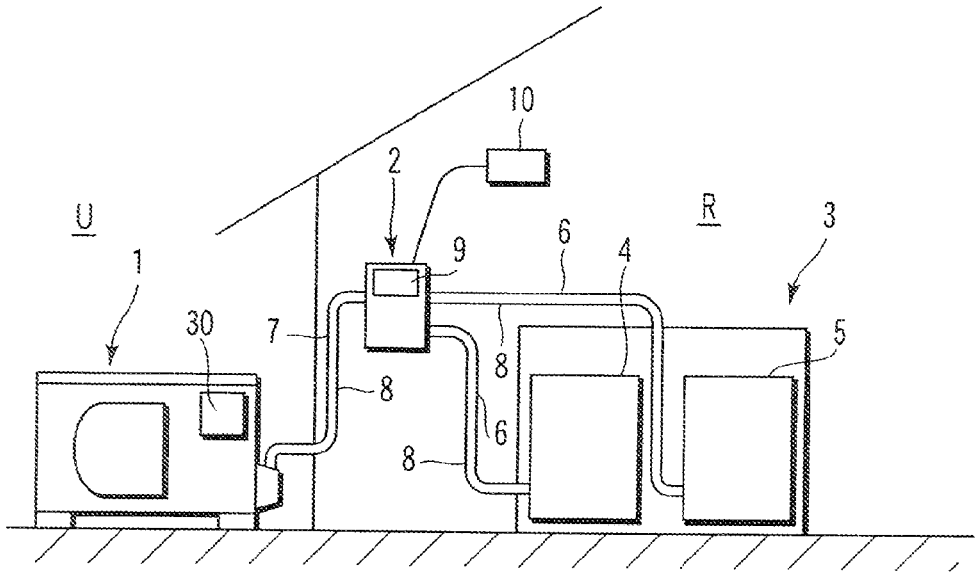
FIG. 1 is a view schematically showing the basic configuration of a heat-pump-type water heater according to an embodiment of the present invention.
Figure 2:
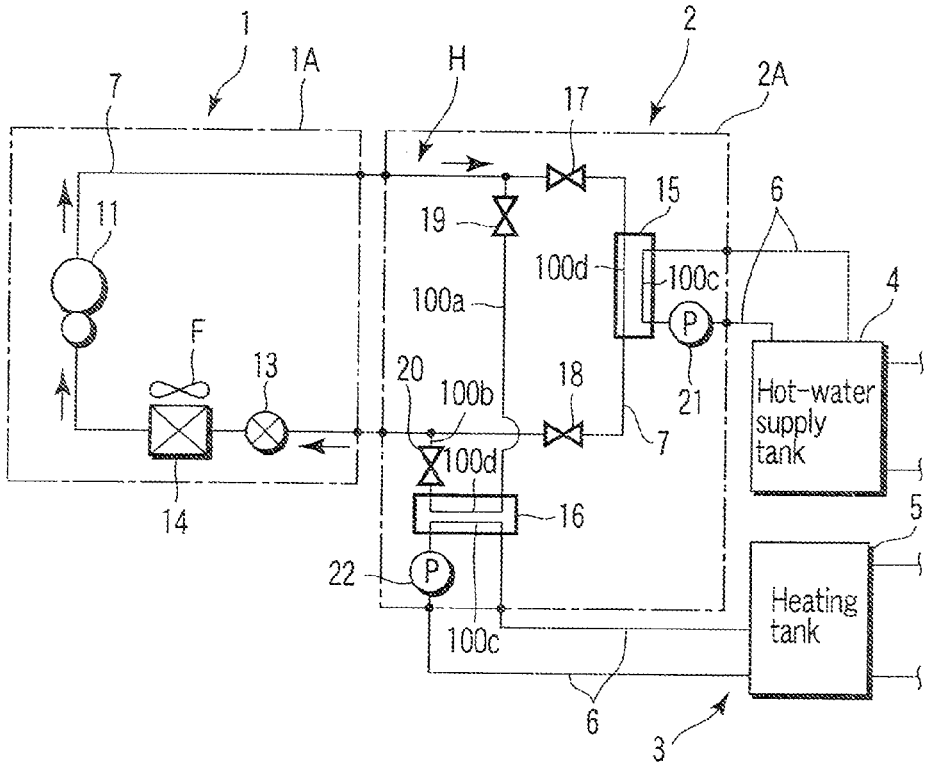
FIG. 2 is a system diagram of a refrigeration cycle and a system diagram of the water piping of the heat-pump-type water heater according to this embodiment.
Figure 3:
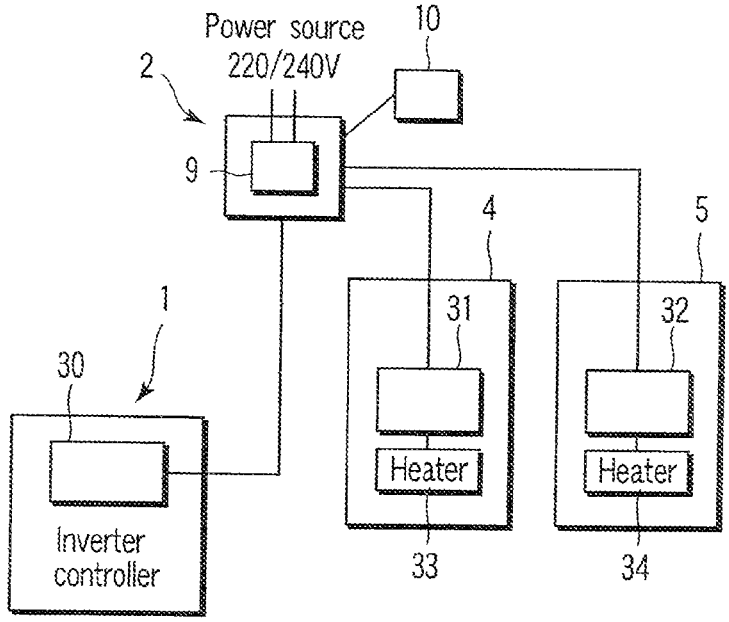
FIG. 3 is a view showing the configuration of an electric control system for the heat-pump-type water heater according to this embodiment.

FIG. 1 is a view schematically showing the configuration of the heat-pump-type water heater, FIG. 2 is a system diagram of a refrigeration cycle and a system diagram of the water piping of the heat-pump-type water heater, and FIG. 3 is a view showing the configuration of an electric control system for the heat-pump-type water heater according to this embodiment.

The heat-pump-type water heater shown in FIG. 1 includes: a heat source unit 1 disposed outdoors U; a hydrothermal exchange unit 2 (described below) of a so-called wall-mounted type, attached to a wall surface of a utility room R as in a house; and a tank unit 3 installed near the hydrothermal exchange unit 2. The hydrothermal exchange unit 2 may be placed on a floor.

The tank unit 3 has a hot-water supply tank 4 and a heating tank 5, which are connected to the hydrothermal exchange unit 2 via corresponding water pipes 6 and electric wiring 8. The heat source unit 1 and the hydrothermal exchange unit 2 are connected via a refrigerant pipe 7 and electric wiring 8.

A controller 9 provided in the hydrothermal exchange unit 2 is electrically connected to a hot-water supply/heating remote controller 10 attached to a front panel of a housing 2A (described below). The heat source unit 1 also has a controller 30. Via the controller 9 of the hydrothermal exchange unit 2, the hot-water supply/heating remote controller 10 controls the controller 30 of the heat source unit 1 and electric devices accommodated in the tank unit 3.

Next, a description will be given of a heat-pump-type refrigeration cycle circuit H shown in FIG. 2. The refrigeration cycle circuit H extends from the heat source unit 1 to the hydrothermal exchange unit 2 such that the refrigerant pipe 7 connects a compressor 11, use side heat exchangers (namely a first water heat exchanger 15 and second water heat exchanger 16), an electronic expansion valve (pressure reducing mechanism) 13, and a heat-source-side heat exchanger 14.

The compressor 11, electronic expansion valve 13, and heat-source-side heat exchanger 14 are disposed in a housing 1A as the components of the heat source unit 1. Opposite the heat-source-side heat exchanger 14 is an outdoor blower F, which sends forth a current of air to the heat exchanger 14. The first and second water heat exchangers 15 and 16 are disposed in a housing 2A as the components of the hydrothermal exchange unit 2 in a manner described below.

The first water heat exchanger 15 is attached to midstream of the refrigerant pipe 7 connecting a discharge part of the compressor 11 and the electronic expansion valve 13. Disposed between the discharge part or the compressor 11 and the first water heat exchanger 15 is a first opening/closing valve 17. Disclosed between the first water heat exchanger 15 and the electronic expansion valve 13 is a second opening/closing valve 18.

In the hydrothermal exchange unit 2, a branch pipe 100*a* branches from the refrigerant pipe 7 that connects the discharge part of the compressor 11 and the first opening/closing valve 17. Connected to the branch pipe 100*a* is one of the connection parts of the second water heat exchanger 16 via a third opening/closing valve 19. Likewise, another branch pipe 100*b* branches from the refrigerant pipe 7 that connects the second opening/closing valve 18 and the electronic expansion valve 13. Connected to the branch pipe 100*b* is the other one of the connection parts of the second water heat exchanger 16 via a fourth opening/closing valve 20. Thus, the first and second water heat exchangers 15 and 16 are disposed parallel to each other relative to the refrigeration cycle circuit H.

Each of the first and second water heat exchangers 15 and 16 has a water heat exchange part 100*c* connected to the water pipes 6, and effectively exchanges heat with a refrigerant heat exchange part 100*d* disposed in the refrigeration circuit H. In this embodiment, the first water heat exchanger is referred to as "water heat exchanger 15 for hot water supply" and the second water heat exchanger as "water heat exchanger 16 for heating".

Further, in the hydrothermal exchange unit 2, a pump 21 is connected to the corresponding water pipes 6 connected to the water heat exchanger 15 for hot water supply, and another pump 22 to the corresponding pipes 6 connected to the water heat exchanger 16 for heating. The pump connected to the water heat exchanger 5 via the water pipes 6 will hereinafter be referred to as the "hot-water supply pump 21," and the pump connected to the water heat exchanger 16 via the water pipes 6, the "heating pump 22".

The hot-water supply pump 21 and the water heat exchanger 15 for hot water supply communicate with the hot-water supply tank 4 via the water pipes 6, and the heating pump 22 and the water heat exchanger 16 for heating communicate with the heating tank 5 via the water pipes 6.

Next, a description will be given of the basic configuration of the control system shown in FIG. 3. The controller 9 of the hydrothermal exchange unit 2 electrically connected to the hot-water supply/heating remote controller 10 is supplied with a commercial power source. The second controller 9 of the hydrothermal exchange unit 2 inverter-controls each electronic device via the controller 30 attached to the heat source unit 1.

The controller 9 of the hydrothermal exchange unit 2 is also electrically connected to controllers 31 and 32 provided in the hot-water supply tank 4 and heating tank 5, respectively. Via these controllers 31 and 32 the controller 9 controls, for instance the degree of heating of auxiliary heaters 33 and 34 disposed in the tanks 4 and 5, respectively.

There will next be described the hydrothermal exchange unit 2 in detail.

Figure 4:
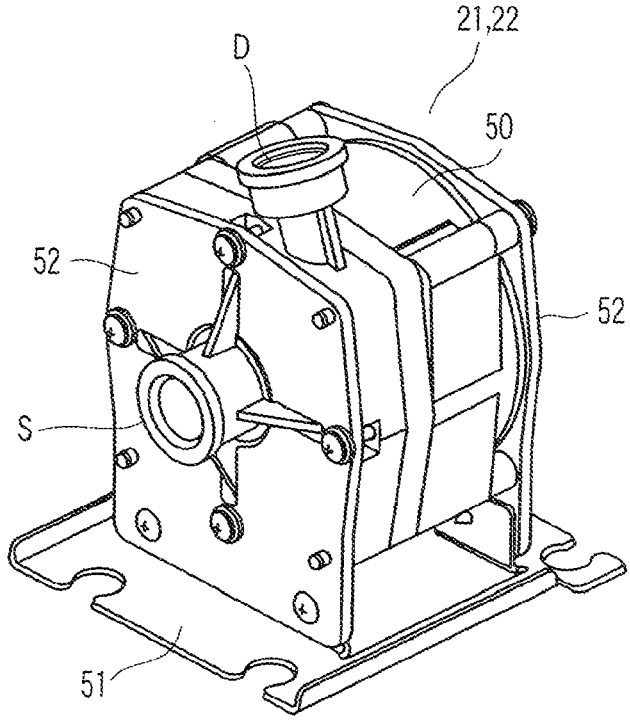
FIG. 4 is a perspective view of the appearance of each hot-water supply pump and heating pump according to this embodiment.
Figure 5:
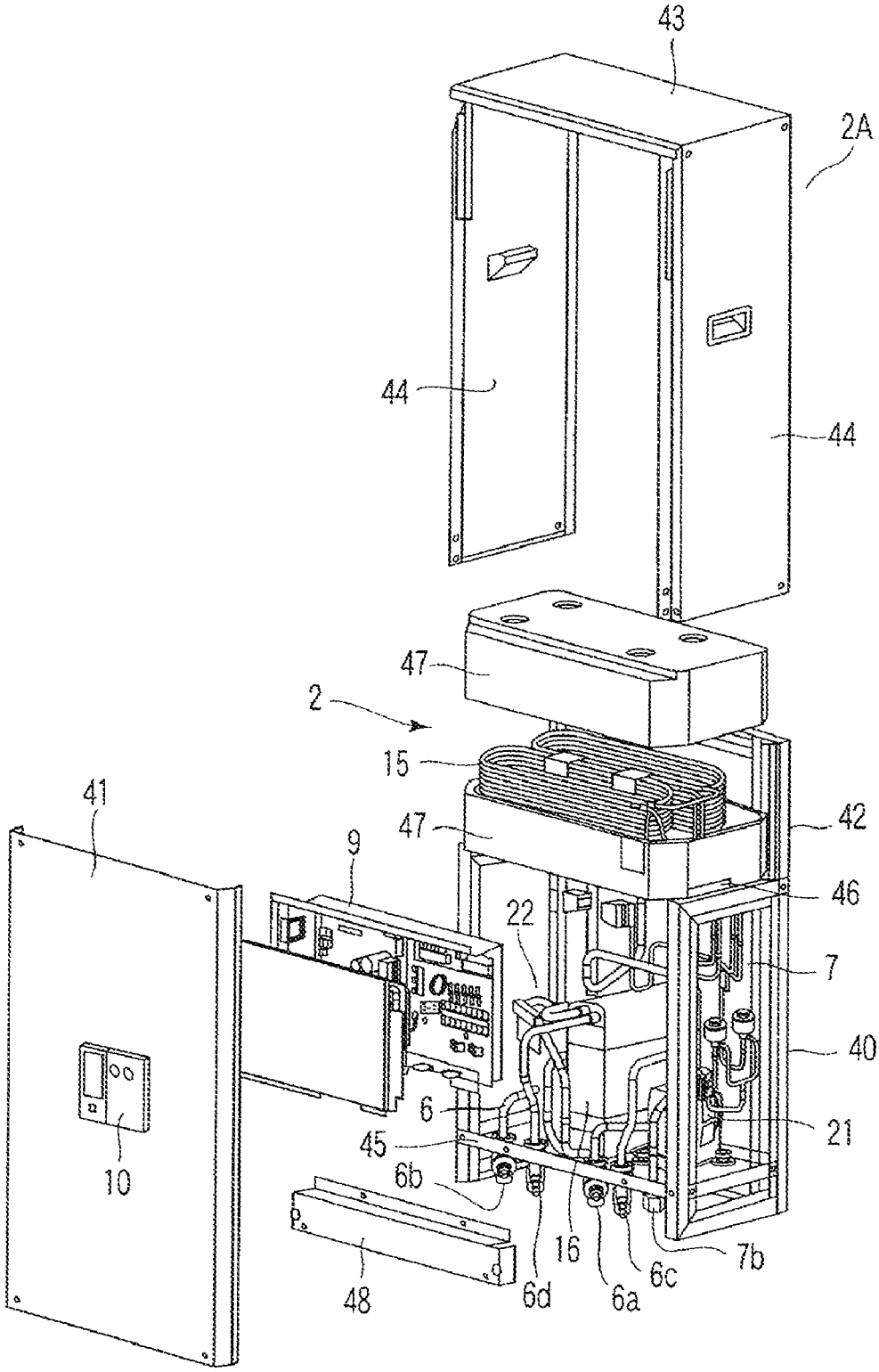
FIG. 5 is an exploded perspective view of the hydrothermal exchange unit according to this embodiment.
Figure 6:
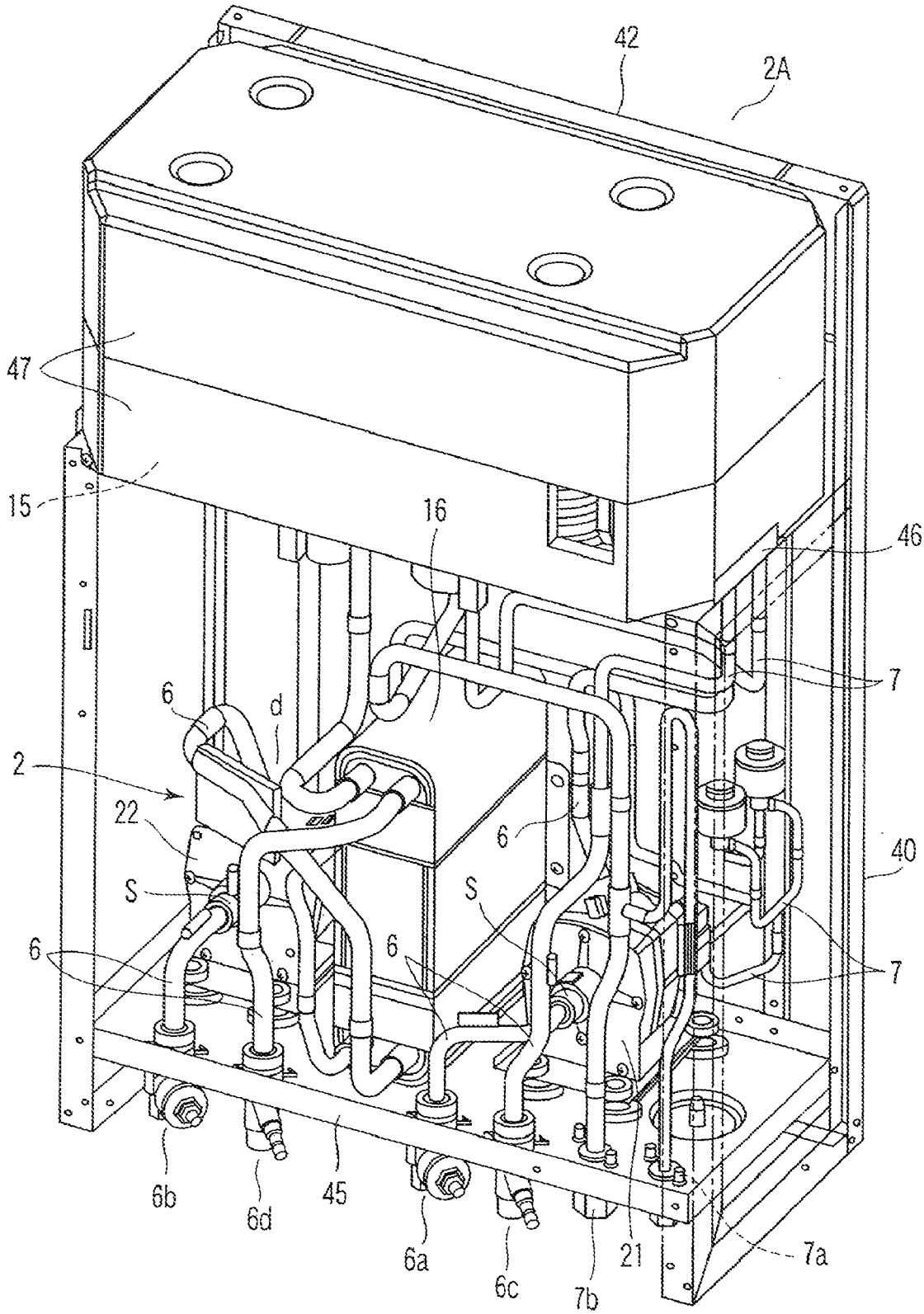
FIG. 6 is a partial perspective view of the assembled hydrothermal exchange unit according to this embodiment.
Figure 7:
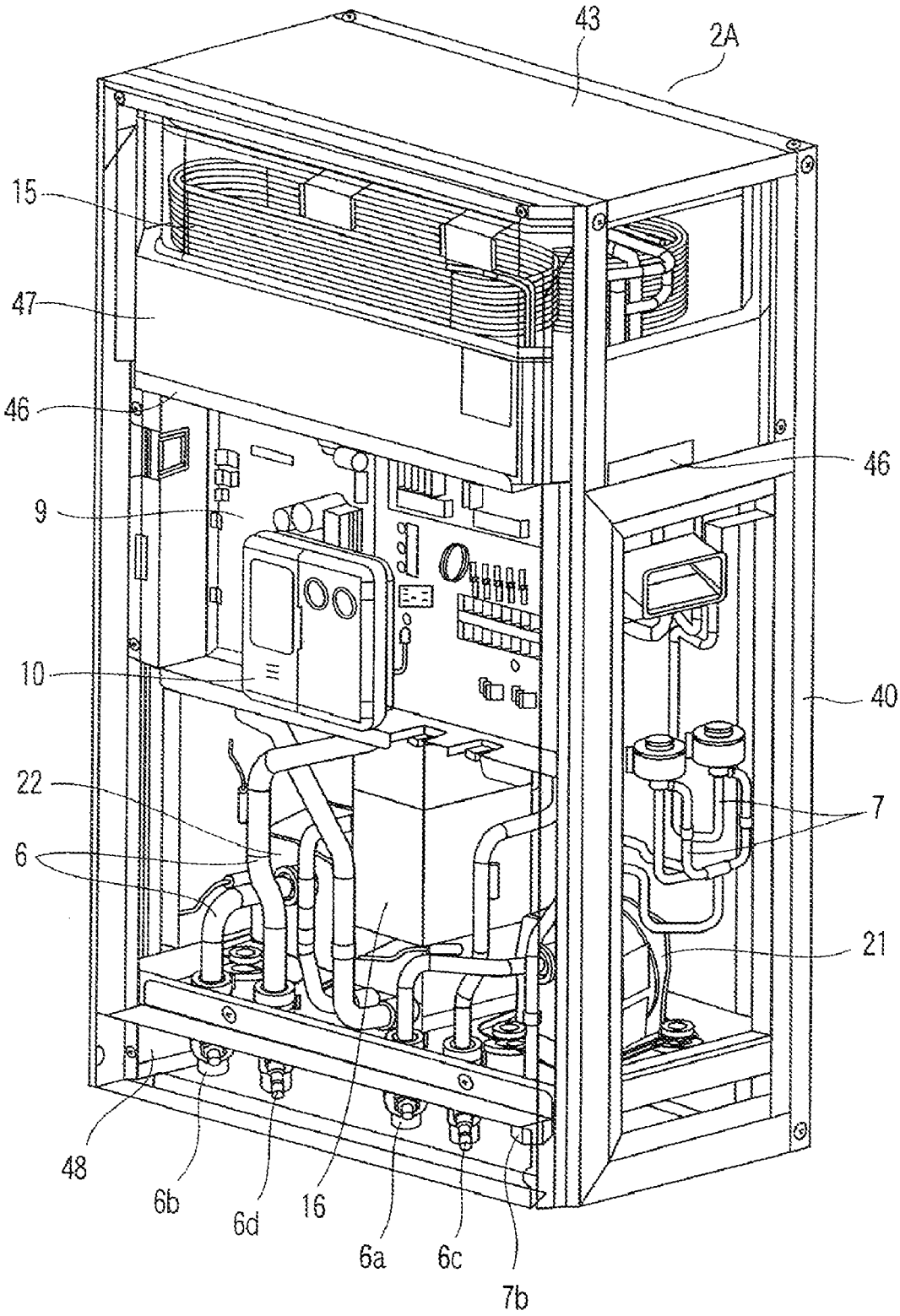
FIG. 7 is a perspective view of the hydrothermal exchange unit according to this embodiment immediately before the completion of the assembly thereof.

FIG. 4 is a perspective view of the hot-water supply pump 21 and heating pump 22 provided in the hydrothermal exchange unit 2, FIG. 5 is an exploded perspective view of the hydrothermal exchange unit 2, FIG. 6 is a partial perspective view of the assembled hydrothermal exchange unit 2, and FIG. 7 is a perspective view of the hydrothermal exchange unit 2 immediately before the completion of the assembly thereof.

The housing 2A for the hydrothermal exchange unit 2 is formed from: a frame 40 having a rectangular shape as viewed from the front, right, left or above; panels 41 to 44 attached to the front, rear, top, right and left sides of the frame 40; and a bottom plate 45.

The edge of one side of the front panel 41 is attached to the frame 40 by hinges (not shown) so that the front panel 41 is freely turnable such that the inside of the housing 2A is easily covered or uncovered. The other panels 42 to 44 are fixed to the external faces of the frame 40 by fasteners. The bottom plate 45 is attached to the frame 40 so as to be a predetermined distance above the lower end of the frame 40 and parallel to the lower end and, accordingly, an empty space is defined below the bottom plate 45.

Upper and lower installation plates (not shown) are attached to the back of the rear panel 42 so that there is a space between the installation plates. These installation plates are used to mount the housing 2A on the wall surface of the utility room R.

The inside of the housing 2A is divided into upper and lower spaces by a horizontal partition 46 such that the lower space is larger than the upper space. Disposed in the space above the horizontal partition 46 is the water heat exchanger 15 for hot water supply, which is entirely surrounded by a heat insulation material 47.

The water heat exchanger 15 for hot water supply is formed from two sets of heat exchange parts, right and left as viewed from above. Each set is formed from a refrigerant pipe for conducting a refrigerant and a water pipe for conducting water, vertically disposed in close contact with each other. The two pipes are wound so as to form two elongated circles, one elongated circle inside the other as viewed from above. The trailing end of the water pipe of the one set is connected to the leading end of the water pipe of the other set, and the trailing end of the refrigerant pipe of the one set is connected to the leading end of the refrigerant pipe of the other set.

On the other hand, disposed on the bottom plate 45 of the housing, or in the space below the horizontal 20C partition 46, are the pumps 21 and 22 disposed sidewise with a space between them. Between the pumps 21 and 22 is the water heat exchanger 16 for heating. The pump on the right side of the drawing is the hot-water supply pump 21, and the pump on the left side of it is the heating pump 22.

The water heat exchanger 16 for heating has a so-called plate-type heat exchanger structure and is accommodated in a box such that plates with the water pipes thereon alternate with plates with the refrigerant pipes thereon. The plates are disposed parallel to one another so that the water pipes form one passage and the refrigerant pipes also form one passage.

The pump 21 for hot water supply and the pump 22 for heating each include: a pump body 50 having a suction portion S and a discharge portion D; a pump base 51, which is made of metal, supports the pump body 50 and is fixed to the surface of the housing bottom plate 45; and a pair of cover members 52, which are made of a metal plate, are mounted on the pump base 51, and sandwich the pump body 50 so as to cover both sides thereof.

The water pipes 6 connected to the suction portions S of the hot water supply pump 21 and heating pump 22 extend in the space below the horizontal partition 46, pass through the housing bottom plate 45, project beyond the underside of the bottom plate 45, and connect to water pipe connectors 6*a* and 6*b* at the respective ends of the pipes 6. The water pipe 6 connected to the discharge portion D of the hot-water supply pump 21 passes through the horizontal partition 46 and extends upward and connects to a water inlet in the water heat exchanger 15 for hot water supply. The water pipe 6 connected to the discharge portion D of the heating pump 22 is connected to a water inlet in the water heat exchanger 16 for heating, which is disposed adjacent to the heating pump 22.

The water pipe 6 connected to a water outlet in the water heat exchanger 15 for hot water supply passes through the horizontal partition 46 and extends into the space below the partition 46. Further, this water pipe 6 passes through the bottom plate 45 and projects beyond the underside of the bottom plate 45 and, connects to a water pipe connector 6*c* at its end. The water pipe 6 connected to a water outlet in the water heat exchanger 16 for heating, which is disposed on the bottom plate 45, passes through the bottom plate 45, projects beyond the underside of the bottom plate 45, and connects to a water pipe connector 6*d* at its end.

Thus, within the housing 2A, the water pipes 6 are accommodated between the horizontal partition 46 and bottom plate 45 so as to be connected to the water heat exchanger 15 for hot water supply and the water heat exchanger 16 for heating, and the refrigerant pipes 7 are also accommodated such that the first to third opening/closing valves 17 to 19 are disposed in the corresponding refrigerant pipes 7. Each two of these refrigerant pipes 7 are grouped together. Each two pipes pass through the bottom plate 45, project beyond the underside of the bottom plate 45 and connect to refrigerant pipe connectors 7*a*, 7*b* at the ends.

The refrigerant pipes 7 extending from the heat source unit 1 are connected to the corresponding refrigerant pipe connectors 7*a* and 7*b*. The water pipe 6 communicating with the water supply tank 4 is connected to the connectors a and 6*c* for the water pipes 6, one extending from the water heat exchanger 15 for hot water supply and the other from the hot-water supply pump 21. The water pipe 6 communicating with the heating tank 5 is connected to the connectors 6*b* and 6*d* for the water pipes 6, one extending from the water heat exchanger 16 for heating and the other from the heating pump 22.

After the pipes 6 and 7 are connected, a pipe cover 48 is attached to area on the front of the housing 2A and below the bottom plate 45. Thus, the pipe cover 48 shields the pipe connectors 6*a* to 6*d* and 7*a* and 7*b*. The front panels 41 cover the pipe connectors 6*a* to 6*d* and 7*a* and 7*b* together with the pipe cover 48. Accordingly, the housing 2A accommodating the hydrothermal exchange unit 2 is mounted on the wall surface of the utility room R such that the space under the housing bottom plate 45 is sealed. This improves the appearance.

The controller 9 is disposed in a space below the horizontal partition plate 46 and in front, away from the space where the water pipes 6 and refrigerant pipes 7 are disposed. The controller 9 has the hot-water supply pump 21 and heating pump 22 (which are the electric components described above), electric control components (which control the first to fourth opening/closing valves 17 to 20), a printed circuit board, etc., all of which are mounted on a board. When the front panel 41 is open, the controller 9 is completely exposed. As described above, the remote controller 10 is directly attached to the front panel 41.

In a heat-pump-type water heater having the foregoing configuration, the compressor 11 provided in the heat source unit 1 is driven in response to the remote controller 10 giving an instruction to start an operation, and a refrigerant gas, the temperature and pressure of which have been increased to high levels is discharged from the compressor 11. While being guided by the water heat exchanger 15 for hot water supply and the water heat exchanger 16 for heating, the refrigerant gas condenses and thereby emits condensation heat. This refrigerant gas then passes through the heat-pump-type refrigeration cycle circuit H.

Simultaneously with this, the hot-water supply pump 21 and the heating pump 22 are driven such that water is guided from the hot-water supply tank 4 and heating tank 5 to the water heat exchangers 15 and 16 connected to the pumps 21 and 22, respectively. In each of the water heat exchangers 15 and 16, water absorbs the condensation heat of the refrigerant and is heated as a result of the water temperature increase. This hot water is guided to the hot-water supply tank 4 and heating tank 5 and stored therein.

By turning on a hot water tap, the hot water in the hot-water supply tank 4 is supplied, and also the same quantity of water is supplied into the hot-water supply tank 4. In addition, by depressing the heating operation start button of the remote controller 10, hot water is supplied from the heating tank 5 to a floor heating panel. The hot water radiates heat throughout the floor heating panel, thereby heating the floor. The hot water the temperature of which has decreased as a result of radiation returns to the heating tank 5 again. Hot water the temperature of which has increased to a predetermined temperature is then re-supplied from the heating tank 5 to the floor heating panel. Thus, the hot water circulates between the tank 5 and the panel.

In the present invention, the hydrothermal exchange unit 2 is independent of the heat source unit disposed outdoors U and, therefore, can be disposed in the utility room R inside a house. The configuration of the hydrothermal exchange unit 2 is substantially identical to that of an ordinary separate type air conditioner. Just as in such an air conditioner, the hydrothermal exchange unit 2 can be installed, which simplifies conditions for installation.

The hydrothermal exchange unit 2 and tank unit 3 are installed in the utility room R. These units 2 and 3 are connected via the water pipes 6 and electric wiring 8. Accordingly, all the water pipes 6 are laid inside a building and are therefore unaffected by outside air temperature. This prevents water in the pipes from freezing and improves usability.

The connectors 6*a* to 6*d*, 7*a* and 7*b* for the water pipes 6 and refrigerant pipes 7 project from the bottom plate 45 of the housing 2A of the hydrothermal exchange unit 2. This facilitates pipe laying, such as pipe connection, and other service tasks. Opening the front panel 41 of the housing 2A facilitates the inspection of the electric control components of the controller 9 and tasks for other services relating to them, thereby improving workability. In addition, detaching the controller 9 facilitates the inspection of the water pipes 6 and refrigerant pipes 7 disposed inside the housing 2A.

Further, the inside of the housing 2A is divided by the horizontal plate 46 into upper and lower spaces. Disposed in the upper space is the water heat exchanger 15 for hot water supply. Disposed in the lower space are the water heat exchanger 16 for heating, the hot-water supply pump 21, the heating pump 22, pipes, etc. This makes the housing 2A vertically thinner and allows installation of the housing 2A on a wall. This also ensures wider spaces surrounding the hot-water supply pump 21 and heating pump 22. Simply opening the front panel 41 allows easy access to the pumps 21 and 22 when any service task is required.

In addition, since both sides of each of pump bodies 50 constructing the hot-water supply pump 21 and heating pump 22 are covered with cover members 52 made of a metal plate, the pumps 21 and 22 highly withstand water pressure. The cover members 52 attached to the pump base 51 made of metal improve the stability of the mounted cover members 52. Further, the cover members 52 on both the sides are made of sheet metal in identical shape, which reduces the material and molding costs.

It is to be understood that the invention is not limited to the embodiment described above but various changes and modifications may be made without departing from the scope of the invention. The invention is capable of various other embodiments by suitable combination or arrangement of the components and elements disclosed in the embodiment described above.

The invention completely prevents freezing of water pipes, improves usability, simplifies conditions for installation, enhances operating efficiency, and improves appearance by covering the pipe connectors.

What is claimed is:

1. A heat-pump-type water heater comprising:

a heat source unit including: a compressor, a pressure reducing mechanism, and a heat-source-side heat exchanger, all of which compose one section of a heat-pump-type refrigeration cycle; and a first controller which controls operations of an outdoor blower and electric devices;

a hydrothermal exchange unit disposed apart from the heat source unit, connected to the heat source unit by means of refrigerant pipes and electric wiring, and including: a water heat exchanger composing part of the other section of the heat-pump-type refrigeration cycle and serving as a use side heat exchanger; a pump which guides water via a water pipe to the water heat exchanger; and a second controller which controls the operation of the pump; and a tank unit connected to the hydrothermal exchange unit via water pipes and including a tank which stores hot water obtained as a result of heat exchange by the water heat exchanger, wherein the hydrothermal exchange unit has a housing, the front, rear, top, left and right sides of the housing being covered with panels and a bottom plate for the housing being disposed a predetermined distance above lower ends of the panels, and the housing has an internal space that accommodates the water heat exchanger, the pump, the water pipes, the refrigerant pipes, and the second controller, and an external space below the bottom plate of the housing that accommodates connectors for the water pipes and refrigerant pipes, the bottom side of the external space being open to a room outside of the housing in which the hydrothermal exchange unit is disposed, and the front side of the external space being provided with a pipe cover having a height sized in accordance with the vertical extent of the connectors for the water pipes and refrigerant pipes, and wherein the second controller is removably attached in a front portion of the internal space of the housing, and adjacent to the front side of the housing, so that the second controller is easily accessed by the removal of the front side, and the water pipes and the refrigerant pipes are readily accessible when the second controller is removed from the housing.

2. The heat-pump-type water heater of claim 1, further comprising a remote controller attached to a front panel of the housing, wherein the remote controller is electrically connected to the second controller and controls the first controller.

3. A heat-pump-type water heater comprising:

a heat source unit including: a compressor, a pressure reducing mechanism, and a heat-source-side heat exchanger, all of which compose one section of a heat-pump-type refrigeration cycle; and a first controller which controls operations of an outdoor blower and electric devices;

a hydrothermal exchange unit disposed apart from the heat source unit, connected to the heat source unit by means of refrigerant pipes and electric wiring, and including: a plurality of water heat exchangers composing part of the other section of the heat-pump-type refrigeration cycle and serving as a use side heat exchanger; a plurality of pumps which guide water via corresponding water pipes to the corresponding water heat exchangers; and a second controller which controls the operations of the pumps; and a tank unit connected to the hydrothermal exchange unfit via water pipes and including a plurality of tanks which store hot water obtained as a result of heat exchange by the corresponding water heat exchangers, wherein the hydrothermal exchange unit has a housing, the front, rear, top, left and right sides of the housing being covered with panels and a bottom plate for the housing being disposed a predetermined distance above lower ends of the panels, and an upper space of the inside of the housing accommodates one of the water heat exchangers, a lower space thereof accommodates the other one of the water heat exchangers, the water pipes and the refrigerant pipes, and the front lower space of the housing accommodates the second controller such that a front panel is attached to the housing so as to freely cover or uncover the second controller, and an external space below the bottom plate of the housing accommodates connectors for the water pipes and refrigerant pipes, the bottom side of the external space being open to a room outside of the housing in which the hydrothermal exchange unit is disposed, and the front side of the external space being provided with a pipe cover having a height sized in accordance with the vertical extent of the connectors for the water pipes and refrigerant pipes, and wherein the second controller is removably attached in the front lower space of the housing, and adjacent to the front panel of the housing, so that the second controller is easily accessed by the removal of the front panel, and the water pipes and the refrigerant pipes are readily accessible when the second controller is removed from the housing.

4. The heat-pump-type water heater of claim 3, further comprising a remote controller attached to the front panel of the housing, wherein the remote controller is electrically connected to the second controller and controls the first controller.

5. A heat-pump-type water heater comprising:

a heat source unit including: a compressor, a pressure reducing mechanism, and a heat-source-side heat exchanger, all of which compose one section of a heat-pump-type refrigeration cycle; and a first controller which controls operations of an outdoor blower and electric devices;

a hydrothermal exchange unit disposed apart from the heat source unit, connected to the heat source unit by means of refrigerant pipes and electric wiring, and including: a water heat exchanger for hot water supply and a water heat exchanger for hot water heating, which compose part of the other section of the heat-pump-type refrigeration cycle and serve as use side heat exchangers; a hot-water supply pump and a heating pump which guides water via corresponding water pipes to the water heat exchanger for hot water supply and the water heat exchanger for heating, respectively; and a second controller which controls the operations of the hot-water supply pump and heating pump; and a tank unit connected to the hydrothermal exchange unit via water pipes and including a hot water supply tank and a heating tank which store hot water obtained as a result of heat exchange by the water heat exchanger for hot water supply and the water heat exchanger for heating, respectively, wherein the hydrothermal exchange unit has a housing, the front, rear, top, left and right sides of the housing being covered with panels and a bottom plate for the housing being disposed a predetermined distance above lower ends of the panels, and the inside of the housing is divided into an upper space and a lower space by a partition, the space above the partition accommodating the water heat exchanger for hot water supply, the space below the partition accommodating the water heat exchanger for heating, the hot water supply pump, the heating pump, the water supply pipes, the refrigerant pipes, and the second controller, and an external space below the bottom plate of the housing accommodating connectors for the water pipes and refrigerant pipes, the bottom side of the external space being open to a room outside of the housing in which the hydrothermal exchange unit is disposed, and the front side of the external space being provided with a pipe cover having a height sized in accordance with the vertical extent of the connectors for the water pipes and refrigerant pipes, and wherein the second controller is removably attached in a front portion of the space below the partition inside the housing, and adjacent to the front side of the housing, so that the second controller is easily accessed by the removal of the front side, and the water pipes and the refrigerant pipes are readily accessible when the second controller is removed from the housing.

6. The heat-pump-type water heater of claim 5, further comprising a remote controller attached to a front panel of the housing, wherein the remote controller is electrically connected to the second controller and controls the first controller.

7. A heat-pump-type water heater comprising:

a heat source unit including: a compressor, a pressure reducing mechanism, and a heat-source-side heat exchanger, all of which compose one section of a heat-pump-type refrigeration cycle; and a first controller which controls operations of an outdoor blower and electric devices;

a hydrothermal exchange unit disposed apart from the heat source unit, connected to the heat source unit by means of refrigerant pipes and electric wiring, and including: a water heat exchanger composing part of the other section of the heat-pump-type refrigeration cycle and serving as a use side heat exchanger; a pump which guides water via a water pipe to the water heat exchanger; and a second controller which controls the operation of the pump; and a tank unit connected to the hydrothermal exchange unit via water pipes and including a tank which stores hot water obtained as a result of heat exchange by the water heat exchanger, wherein the hydrothermal exchange unit has a housing, the front, rear, top, left and right sides of the housing being covered with panels and a bottom plate for the housing being disposed a predetermined distance above lower ends of the panels, the inside of the housing accommodates the water heat exchanger, the pump, the water pipes, the refrigerant pipes, and the second controller, and the pump includes: a pump body; a pump base, which is made of metal, supports the pump body and is fixed to the surface of the bottom plate of the housing; and a pair of cover members, which are made of a metal plate, are mounted on the pump base, and sandwich the pump body so as to cover both opposite sides of the pump body, and an external space below the bottom plate of the housing accommodates connectors for the water pipes and refrigerant pipes, the bottom side of the external space being open to a room outside of the housing in which the hydrothermal exchange unit is disposed, and the front side of the external space being provided with a pipe cover having a height sized in accordance with the vertical extent of the connectors for the water pipes and refrigerant pipes, and wherein the second controller is removably attached in a front portion of the inside of the housing, and adjacent to the front side of the housing, so that the second controller is easily accessed by the removal of the front side, and the water pipes and the refrigerant pipes are readily accessible when the second controller is removed from the housing.

8. The heat-pump-type water heater of claim 7, further comprising a remote controller attached to a front panel of the housing, wherein the remote controller is electrically connected to the second controller and controls the first controller.

* * * * *